US007869721B2

(12) United States Patent
Thompson et al.

(10) Patent No.: US 7,869,721 B2
(45) Date of Patent: Jan. 11, 2011

(54) APPARATUS AND METHOD FOR DETECTING CARRIER PARTICLES IN AN ELECTROPHOTOGRAPHIC DEVICE

(75) Inventors: Michael D. Thompson, Rochester, NY (US); Paul W. Morehouse, Jr., Webster, NY (US); Diane Foley, Palmyra, NY (US)

(73) Assignee: Xerox Corporation, Norwalk, CT (US)

( * ) Notice: Subject to any disclaimer, the term of this patent is extended or adjusted under 35 U.S.C. 154(b) by 393 days.

(21) Appl. No.: 12/168,268

(22) Filed: Jul. 7, 2008

(65) Prior Publication Data

US 2010/0003040 A1 Jan. 7, 2010

(51) Int. Cl.

| | |
|---|---|
| ***G03G 15/00*** | (2006.01) |
| ***G03G 15/08*** | (2006.01) |
| ***G03G 15/06*** | (2006.01) |
| ***G03G 15/16*** | (2006.01) |
| ***G03G 15/10*** | (2006.01) |
| ***G03G 15/09*** | (2006.01) |

(52) U.S. Cl. ..... 399/26; 399/29; 399/49; 399/55; 399/71; 399/88; 399/101; 399/240; 399/270

(58) Field of Classification Search ..... 399/26, 399/29, 55, 71, 88, 101, 240, 270, 49
See application file for complete search history.

(56) References Cited

U.S. PATENT DOCUMENTS 4,862,828 A * 9/1989 Kumasaka et al. ..... 399/267
4,868,607 A 9/1989 Folkins et al.
5,142,322 A 8/1992 Surti
5,315,357 A 5/1994 Kamijo et al.
5,390,015 A 2/1995 Nagame et al.
6,233,417 B1 5/2001 Nakayama et al.
7,020,427 B2 3/2006 Hart
2007/0223948 A1 * 9/2007 Matsui ..... 399/27

* cited by examiner

*Primary Examiner*—David M Gray
*Assistant Examiner*—Joseph S Wong
(74) *Attorney, Agent, or Firm*—Matthew C. Loppnow; Prass LLP

(57) ABSTRACT

A method (400) and apparatus (100) that detects carrier particles (130) in an electrophotographic device is disclosed. The apparatus may include an image carrying member (110). The image carrying member may have a first side (111) and have a second side (112) opposite from the first side. The image carrying member may be configured to operate in a direction of motion (115). The image carrying member may also be configured to transport an image on the first side. The apparatus may also include a magnet (120) coupled to the second side of the image carrying member. The magnet may have a length (122). The length of the magnet may be at an angle (124) of greater than zero and less than 90 degrees to the direction of motion of the image carrying member. The magnet may be configured to attract toner carrier particles transported on the image carrying member. The apparatus may also include a first sensor (140) coupled in proximity to the first side of the image carrying member and coupled in proximity to the magnet. The first sensor may be configured to sense the toner carrier particles attracted by the magnet. The first sensor may also be configured to output a first signal corresponding to the sensed toner carrier particles.

20 Claims, 5 Drawing Sheets

APPARATUS AND METHOD FOR DETECTING CARRIER PARTICLES IN AN ELECTROPHOTOGRAPHIC DEVICE

BACKGROUND

Disclosed herein is an apparatus and method that detects carrier particles in an electrophotographic device.

Presently, electrophotographic printing machines may use a two component powder development process. The two components can include pigmented resinous powder called toner and larger granular carrier particles, such as carrier beads. Unfortunately, during the development process, the carrier beads can leave a development station, which can contaminate the printing machine. The contamination of a printing machine from the carrier beads can lead to print quality defects. Such print quality defects can include transfer deletions, print non-uniformity due to charger contamination, streaks due to cleaning failures, and ultimately, scratches in the prints from damage to the photoconductor and fuser, which can necessitate replacement of these parts. In severe cases, the development output will also fail as a developer sump falls below a minimum level. The onset for the carrier bead loss from a development subsystem is difficult to detect because it is typically very gradual and starts with a period of low rate of carrier bead loss which can then develop into a catastrophic failure leading to contamination of various printing system components. There are also situations in which this failure can occur due to aging of the carrier or because of continual high cleaning or development electric fields due to a control system compensating for extreme machine environment changes.

Typically, the failure is mitigated by limiting the toner concentration and cleaning electric field range in development as well as by adding auxiliary bead pick-off magnets downstream from development to prevent beads from contaminating the system. Unfortunately, despite the mitigation, the ultimate failure is usually detected too late, for example, when beads are felt on the output print by a user. At that point, the rest of the system is already contaminated, which critically impacts the system.

Thus, there is a need for method and apparatus that detects carrier particles emitted from a two component development system in an electrophotographic device.

SUMMARY

A method and apparatus that detects carrier particles in an electrophotographic device is disclosed. The apparatus may include an image carrying member. The image carrying member may have a first side and have a second side opposite from the first side. The image carrying member may be configured to operate in a direction of motion. The image carrying member may also be configured to transport an image on the first side. The apparatus may also include a magnet coupled to the second side of the image carrying member. The magnet may have a length. The length of the magnet may be at an angle of greater than zero and less than 90 degrees to the direction of motion of the image carrying member. The magnet may be configured to attract toner carrier particles transported on the image carrying member. The apparatus may also include a first sensor coupled in proximity to the first side of the image carrying member and coupled in proximity to the magnet. The first sensor may be configured to sense the toner carrier particles attracted by the magnet. The first sensor may also be configured to output a first signal corresponding to the sensed toner carrier particles.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
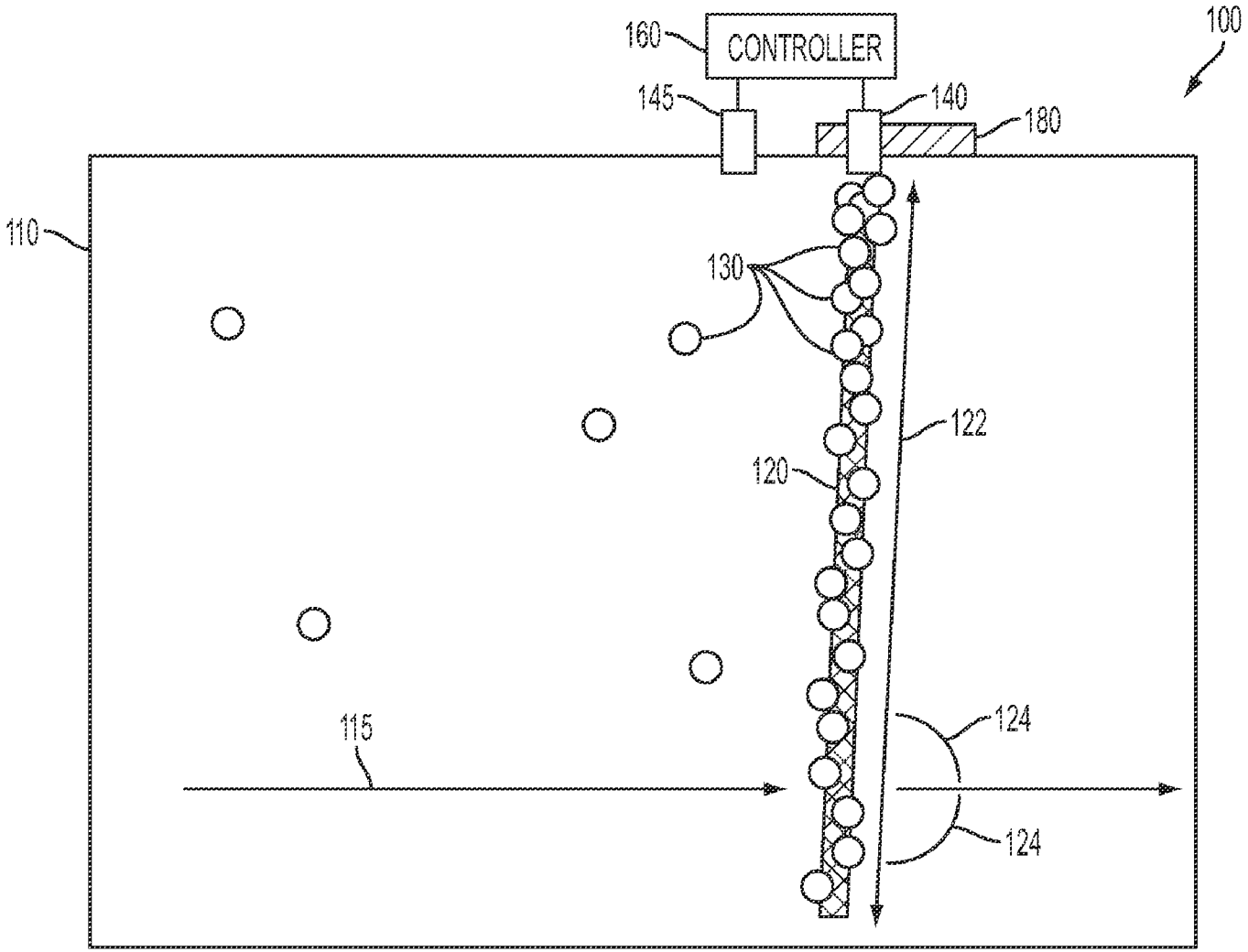
FIG. 1 is an exemplary illustration of an apparatus.

The embodiments include an apparatus that detects bead carryout for an electrophotographic device. The apparatus may include an image carrying member. The image carrying member may have a first side and may have a second side opposite from the first side. The image carrying member may be configured to operate in a direction of motion. The image carrying member may also be configured to transport an image on the first side. The apparatus may also include a magnet coupled to the second side of the image carrying member. The magnet may have a length. The length of the magnet may be at an angle of greater than zero and less than 90 degrees to the direction of motion of the image carrying member. The magnet may be configured to attract toner carrier particles transported on the image carrying member. The apparatus may also include a first sensor coupled in proximity to the first side of the image carrying member and coupled in proximity to the magnet. The first sensor may be configured to sense the toner carrier particles attracted by the magnet. The first sensor may also be configured to output a first signal corresponding to the sensed toner carrier particles.

The embodiments further include a method for detecting bead carryout for an electrophotographic device. The method may include operating an image carrying member in a direction of motion and transporting an image on a first side of the image carrying member. The method may include attracting, to a magnet, toner carrier particles transported on the image carrying member. The method may include directing the toner carrier particles towards an end of the magnet, sensing the toner carrier particles at the end of the magnet, and outputting a first signal corresponding to the sensed toner carrier particles.

The embodiments further include an apparatus that detects bead carryout for an electrophotographic device. The apparatus may include an image carrying member having a first side and a second side opposite from the first side. The image carrying member may be configured to operate in a direction of motion. The image carrying member may be configured to transport an image on the first side. The apparatus may include a magnet coupled to the second side of the image carrying member. The magnet may be configured to attract toner carrier particles transported on the first side of the image carrying member. The magnet may be positioned at an angle with respect to the direction of motion of the image carrying member. The angle may be configured to direct the toner carrier particles towards an end of the magnet. The apparatus may include a first sensor coupled in proximity to the first side of the image carrying member and coupled in proximity to the magnet. The first sensor may be configured to sense the toner carrier particles at the end of the magnet and configured to output a first signal corresponding to the sensed toner carrier particles. The apparatus may include a controller coupled to the first sensor. The controller may be configured to determine a toner carrier particle level based on the first signal.

FIG. 1 is an exemplary illustration of an apparatus 100 according to a possible embodiment. The apparatus 100 may be an electrophotographic device, such as, a printer, a copier, a multifunction media device, a xerographic machine, or any other device that can produce an image on media. The apparatus 100 can include an image carrying member 110 having a first side as shown and a second side opposite from the first side. The image carrying member 110 can be a photoreceptor, a photoreceptor belt, a photoreceptor drum, an intermediate belt, or any other image carrying device that can build up toner carrier particles. The image carrying member 110 can be configured to operate in a direction of motion 115. The image carrying member 110 can be configured to transport an image on the first side.

For example, in an image transfer process using elements not shown, an electrostatic latent image can be created on a first side surface of the image carrying member 110. The latent image can be developed by applying thereto a supply of toner carrier particles 130, such as with a developer roll. The toner carrier particles 130 can adhere to appropriately-charged areas of the latent image. The surface of the image carrying member 110 can then move, as shown by the arrow 115, to a transfer zone while a print sheet on which the desired image is to be printed is drawn from supply stack and conveyed to the transfer zone as well. At the transfer zone, the print sheet can be brought into contact or at least into proximity with a surface of the image carrying member 110, which at this point can be carrying the toner carrier particles 130 thereon. A charge source at the transfer zone can cause the toner on the image carrying member 110 to be electrically transferred to the print sheet. During the image transfer process, residual toner carrier particles 130 can develop on the image carrying member 110.

To detect the toner carrier particles 130, the apparatus 100 can include a magnet 120 coupled to the second side of the image carrying member 110. The magnet 120 can have a length 122. The length 122 may correspond to a longitudinal axis of the magnet 120. The length 122 can be at an angle 124 of greater than zero and less than 90 degrees to the direction of motion 115 of the image carrying member 110. The degree of the angle 124 can be measured from either side of the direction of motion 115. The magnet 120 can be configured to attract toner carrier particles 130 transported on the image carrying member 110.

The apparatus 100 can include a first sensor 140 coupled in proximity to the first side of the image carrying member 110 and coupled in proximity to the magnet 120. The first sensor 140 can be configured to sense the toner carrier particles 130 attracted by the magnet 120. The first sensor 140 can be configured to output a first signal corresponding to the sensed toner carrier particles 130.

The apparatus 100 can include a controller 160 coupled to the first sensor 140. The controller 160 can be configured to determine a toner carrier particle carryout level based on the first signal corresponding to the sensed toner carrier particles. For example, while being attracted to the magnet 120, the toner carrier particles can be carried across the first side of the image carrying member 110 as the image carrying member 110 moves in the movement direction 115. Thus, the magnet 120, the magnet length angle 124, and the direction of motion 115 of the image carrying member 110 can attract toner carrier particles 130 transported on the image carrying member 110 and direct the toner carrier particles 130 towards the first sensor 140. For example, due to frictional forces between the toner carrier particles 130 and the surface of the first side of the image carrying member 110 and due to magnetic gradient forces perpendicular to the magnet 120, the net force on the toner carrier particles 130 can move the toner carrier particles 130 along an axis of the magnet 120 towards the first sensor 140. As or after the toner carrier particles 130 are sensed, they can be deposited into a toner carrier particle collection area 180.

The controller 160 can be configured to output a warning based on the toner carrier particle carryout level exceeding a threshold. The controller 160 can also be configured to set a limit on a development electric field and/or a cleaning electric field of the apparatus 100 based on the toner carrier particle carryout level exceeding a threshold.

The apparatus 100 can include a second sensor 145 coupled in proximity to the first side of the image carrying member 110. The second sensor 145 can be configured to sense conditions of the image carrying member 110 away from the toner carrier particles 130 attracted by the magnet 120. The second sensor 145 can be configured to output a second signal corresponding to the sensed conditions. The controller 160 can be coupled to the second sensor. The controller 160 can be configured to determine a toner carrier particle carryout level based on a difference between the first signal from the first sensor 140 corresponding to the sensed toner carrier particles and the second signal from the second sensor 145 corresponding to the sensed conditions.

Figure 2:
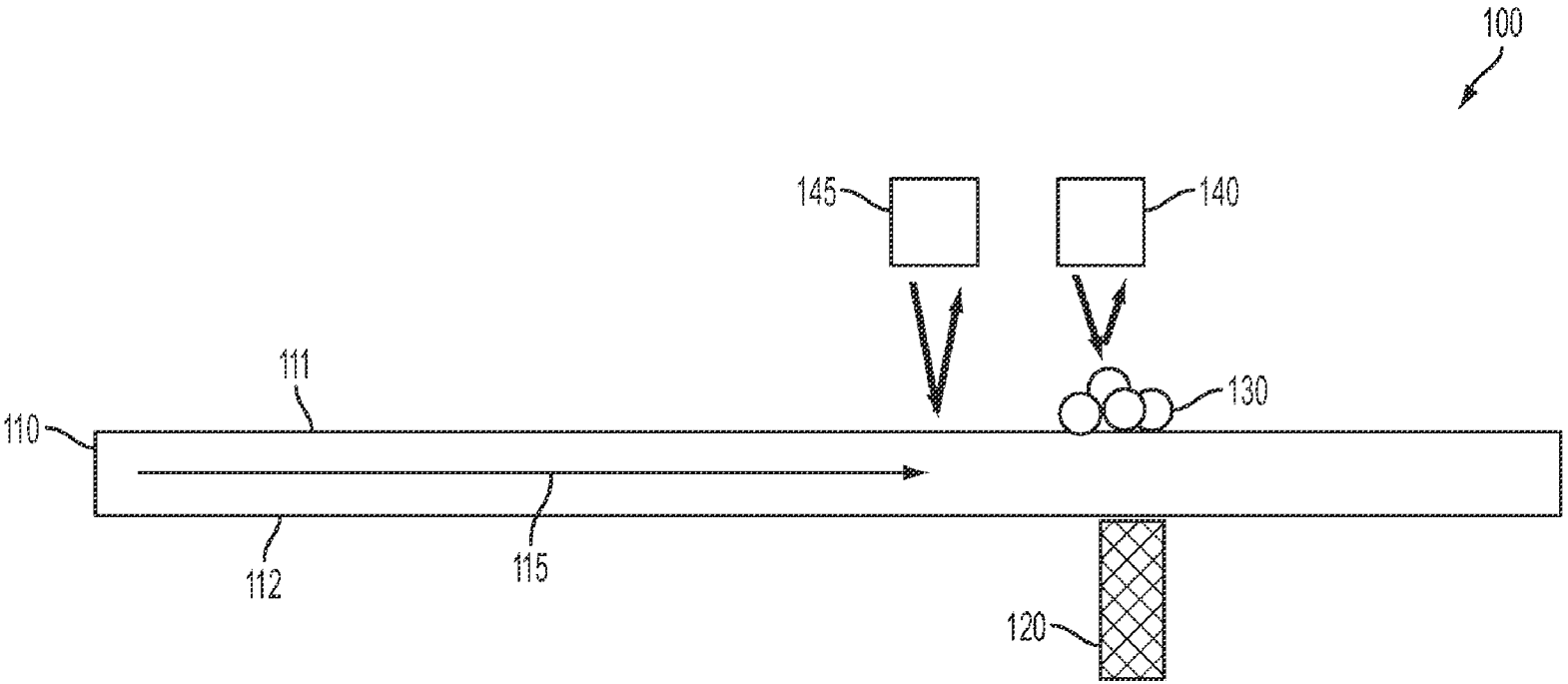
FIG. 2 is an exemplary illustration of a side view of an apparatus.

FIG. 2 is an exemplary illustration of a side view of the apparatus 100 according to a possible embodiment. The apparatus 100 can include the image carrying member 110 that can move in a movement direction 115. The image carrying member 110 can include a first side 111 and a second side 112 opposite from the first side 111. The image carrying member 110 can carry an image on the first side 111. The sensors 140 and 145 can be located in close enough proximity to the first side 111 to sense toner carrier particles 130 and conditions on the first side 111. The magnet 120 can be located on the second side 112 in close enough proximity to attract the toner carrier particles 130.

According to another related embodiment, the apparatus 100 can include an image carrying member 110 having a first side 111 and a second side opposite 112 from the first side 111. The image carrying member 110 can be configured to operate in a direction of motion 115. The image carrying member 110 can be configured to transport an image on the first side 111. The apparatus 100 can include a magnet 120 coupled to the second side 112 of the image carrying member 110. The magnet 120 can be configured to attract toner carrier particles 130 transported on the first side 111 of the image carrying member 110. The magnet 120 can be positioned at an angle 124 with respect to the direction of motion 115 of the image carrying member 110. The angle 124 can be configured to direct the toner carrier particles 130 towards an end of the magnet 120.

The apparatus 100 can include a first sensor 140 coupled in proximity to the first side 111 of the image carrying member 110 and coupled in proximity to the magnet 120. The first sensor 140 can be configured to sense the toner carrier particles 130 at the end of the magnet 120. For example, the first sensor 140 can be located at the end of the magnet 120 at which the toner carrier particles 130 are directed and the first sensor 140 can sense the toner carrier particles 130 at the end of the magnet 120 by the sensor 140. The first sensor 140 can be configured to output a first signal corresponding to the sensed toner carrier particles 130. The apparatus 100 can include a controller 160 coupled to the first sensor 140. The controller 160 can be configured to determine a toner carrier particle level based on the first signal output by the first sensor 140. The controller 160 can be configured to determine when the toner carrier particle level exceeds a threshold and can be configured to adjust operations of the apparatus 100 in response to the toner carrier particle level exceeding a threshold. For example, the controller 160 can adjust operations of the apparatus 100 by outputting a warning, by setting a level of a development electric field, by setting a level of a cleaning electric field, or by adjusting other relevant operations of the apparatus 100.

The apparatus 100 can include a second sensor 145 configured to sense conditions of the first side 111 of the image carrying member 110 away from the toner carrier particles 130 attracted by the magnet 120. The second sensor 145 can be configured to output a second signal corresponding to the sensed conditions. The controller 160 can be configured to determine the toner carrier particle level based on a comparison of the first signal with the second signal.

Thus, the apparatus 100 can identify a toner carrier particle, such as a carrier bead or developer bead, carryout problem in a magnetic brush development system before a hard failure occurs. The magnetic property of the toner carrier particles 130 can be used to concentrate them to a level that can be sensed by the sensor 140. A magnet 120 can be used with a high enough of a gradient to attract the toner carrier particles 130. The magnet 120 can be placed behind the image carrying member 110, such as a photoconductor or an intermediate belt. The magnet 120 can be angled 124 relative to the direction of motion 115 of the image carrying member 110 such that the motion of the image carrying member 110 can march the captive toner carrier particles 130 off one side of the image carrying member 110 to be sensed by the first sensor 140 and collected in the collection area 180. This can effectively concentrate the toner carrier particles 130 and make them detectable to the first sensor 140, such as an optical sensor, a magnetic permeability sensor, or other useful sensor. A signal can be taken by the second sensor 145 of a relatively bare area of the image carrying member 110 near the collection point 180. The signal from the second sensor 145 can be compared to the signal from the first sensor 140 to determine the toner carrier particle carryout level. The apparatus 100 can provide minimal drag on the image carrying member 110 and the interface between the toner carrier particles 130 and the image carrying member 110 can be small and gentle. The apparatus 100 can use minimal moving or powered parts added aside from the sensor 140 to detect the toner carrier particle carryout level. The embodiments can be applied to a belt photoconductor, an intermediate belt, a drum photoconductor, or any other image carrying member 110.

For example, the apparatus 100 can use a magnet 120 mounted inside a photoconductor 110 cavity. The apparatus 100 can also use a collection box 180, such as one used for a blade cleaner or used for a bead removal device. One or both sensors 140 and 145 can indicate a difference in reflectivity of the bare photoconductor 110 compared to the area with the high concentration of beads by the sensor 140. A threshold level can be determined for normal bead carryout levels and when the threshold is exceeded, the controller 160 can set a limit on a development electric field, set a limit on a cleaning potential field, warn an operator before a hard failure occurs, or perform any other appropriate function. The apparatus 100 can provide early warning system for bead carryout which can help avoid costly cleaning and costly replacement of printer system parts.

Figure 3:
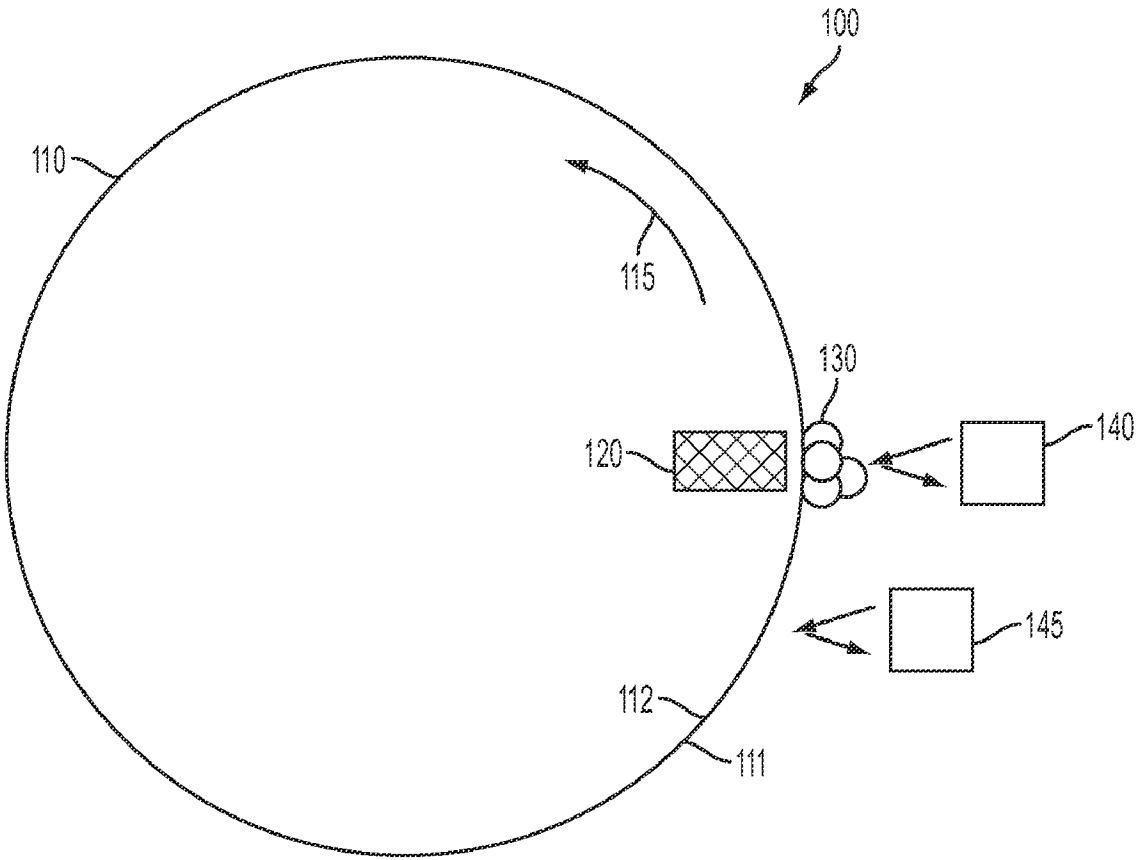
FIG. 3 is an exemplary illustration of a side view of an apparatus.

FIG. 3 is an exemplary illustration of a side view of the apparatus 100 according to a possible embodiment. The apparatus 100 can include an image carrying member 110 having a first side 111 and a second side opposite 112 from the first side 111. The image carrying member 110 can be a drum photoreceptor having an exterior and an interior. The first side 111 of the image carrying member 110 can correspond to the exterior of the drum and the second side 112 of the image carrying member 110 can correspond to the interior of the drum. The image carrying member 110 can be configured to operate in a direction of motion 115. The image carrying member 110 can be configured to transport an image on the first side 111. The apparatus 100 can include a magnet 120 coupled to the second side 112 of the image carrying member 110, such as in the interior of the drum. The magnet 120 can be configured to attract toner carrier particles 130 transported on the first side 111 of the image carrying member 110. The magnet 120 can be positioned at an angle with respect to the direction of motion 115 of the image carrying member 110. The angle can be configured to direct the toner carrier particles 130 towards an end of the magnet 120. The apparatus 110 can include other related elements from other embodiments. For example, the apparatus 110 can include the sensors 140 and 145 and other elements from the other embodiments.

Figure 4:
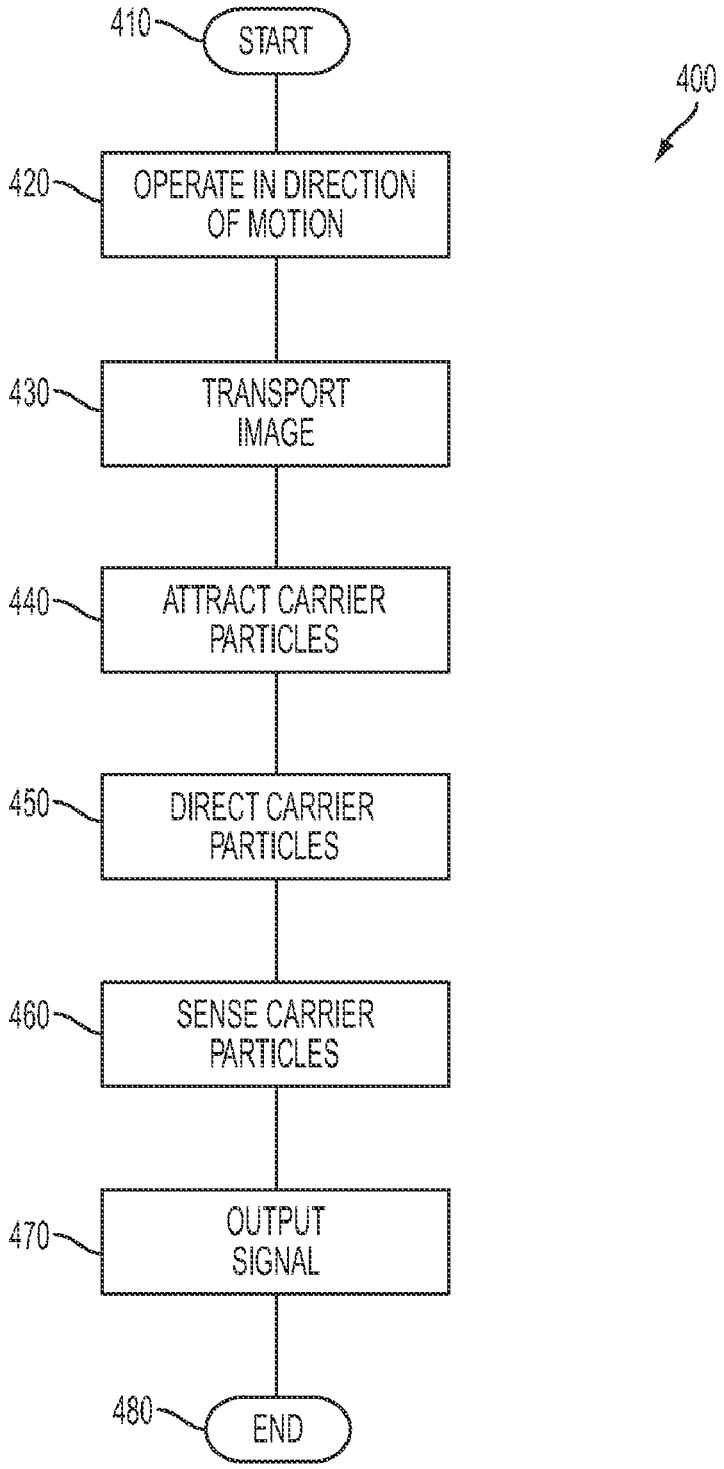
FIG. 4 illustrates an exemplary flowchart of a method of detecting carrier particles in an electrophotographic device.

FIG. 4 illustrates an exemplary flowchart 400 of a method of detecting carrier particles in an electrophotographic device. The electrophotographic device can have an image carrying member having a first side and a second side opposite from the first side. The electrophotographic device can have a magnet coupled to the second side of the image carrying member. The magnet can be positioned at an angle with respect to the direction of motion of the image carrying member. In operation, the method starts at 410. At 420, the image carrying member can operate in a direction of motion. At 430, an image can be transported on the first side of the image carrying member. At 440, toner carrier particles transported on the image carrying member can be attracted to the magnet. At 450, the toner carrier particles can be directed towards an end of the magnet. At 460, the toner carrier particles at the end of the magnet can be sensed. At 470, a first signal corresponding to the sensed toner carrier particles can be output. At 480, the method can end or the method can continue as part of a control loop.

Figure 5:
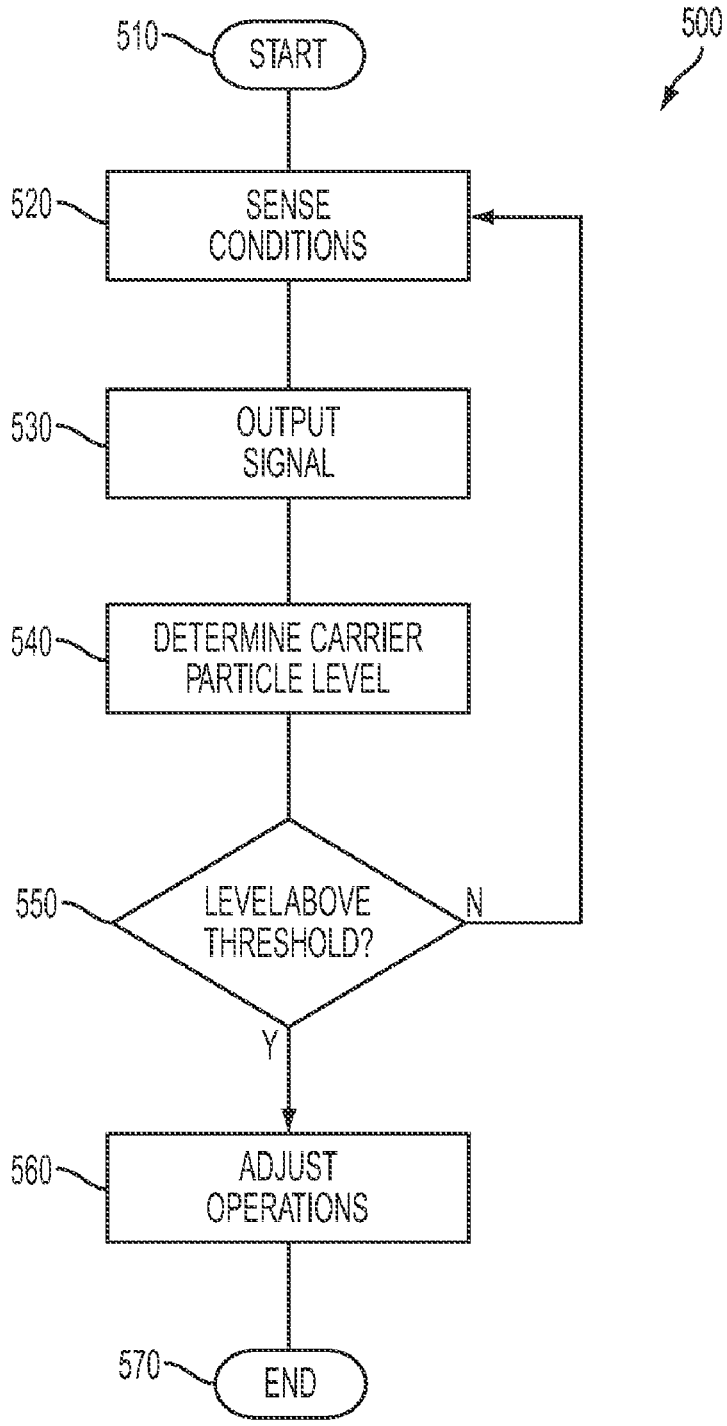
FIG. 5 illustrates an exemplary flowchart of a method of detecting carrier particles in an electrophotographic device.

FIG. 5 illustrates an exemplary flowchart 500 of a method of detecting carrier particles in an electrophotographic device according to a possible embodiment. The flowchart 500 can be used along with the flowchart 400 where relevant elements can be added or exchanged. At 510, the method can begin. At 520, conditions of the image carrying member can be sensed away from toner carrier particles attracted by a magnet. At 530, a second signal corresponding to the sensed conditions can be output. At 540, a toner carrier particle level can be determined based on the first signal corresponding to the sensed toner carrier particles from 470. The toner carrier particle level can also be determined based on comparing the first signal corresponding to the sensed toner carrier particles from 470 with the second signal corresponding to the sensed conditions from 530. At 550, a determination can be made as to whether the toner carrier particle level exceeds a threshold. If not, the method can continue back to 520. If the toner carrier particle level exceeds a threshold, at 560, operations of the electrophotographic device can be adjusted. For example, a warning can be output, a limit on a development electric field can be adjusted or set, a limit on a cleaning electric field can be adjusted or set, or other operations of the electrophotographic device can be adjusted. At 570, the method can end.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

an image carrying member having a first side and a second side opposite from the first side, the image carrying member configured to operate in a direction of motion, the image carrying member configured to transport an image on the first side;

a magnet coupled to the second side of the image carrying member, the magnet having a length, the length being at an angle of greater than zero and less than 90 degrees to the direction of motion of the image carrying member, the magnet configured to attract toner carrier particles transported on the image carrying member; and a first sensor coupled in proximity to the first side of the image carrying member and coupled in proximity to the magnet, the first sensor configured to sense the toner carrier particles attracted by the magnet and configured to output a first signal corresponding to the sensed toner carrier particles.

2. The apparatus according to claim 1, further comprising a controller coupled to the first sensor, the controller configured to determine a toner carrier particle carryout level based on the first signal corresponding to the sensed toner carrier particles.

3. The apparatus according to claim 2, wherein the controller is configured to output a warning based on the toner carrier particle carryout level exceeding a threshold.

4. The apparatus according to claim 2, wherein the controller is configured to set a limit on at least one selected from the group of a development electric field and a cleaning electric field based on the toner carrier particle carryout level exceeding a threshold.

5. The apparatus according to claim 1, further comprising a second sensor coupled in proximity to the first side of the image carrying member, the second sensor configured to sense conditions of the image carrying member away from the toner carrier particles attracted by the magnet and configured to output a second signal corresponding to the sensed conditions.

6. The apparatus according to claim 5, further comprising a controller coupled to the first sensor and the second sensor, the controller configured to determine a toner carrier particle carryout level based on a difference between the first signal corresponding to the sensed toner carrier particles and the second signal corresponding to the sensed conditions.

7. The apparatus according to claim 1, wherein the image carrying member comprises a drum having an exterior and an interior, the first side of the image carrying member corresponding to the exterior of the drum, the second side of the image carrying member corresponding to the interior of the drum.

8. The apparatus according to claim 1, wherein the image carrying member comprises one selected from the group of a photoreceptor, a photoreceptor belt, a photoreceptor drum, and an intermediate belt.

9. The apparatus according to claim 1, wherein the magnet, the magnet length angle, and the direction of motion of the image carrying member are configured to attract toner carrier particles transported on the image carrying member and direct the toner carrier particles towards the first sensor.

10. A method in an apparatus including an image carrying member having a first side and a second side opposite from the first side, and a magnet coupled to the second side of the image carrying member and positioned at an angle with respect to the direction of motion of the image carrying member, the method comprising:

operating the image carrying member in a direction of motion;

transporting an image on the first side of the image carrying member;

attracting, to the magnet, toner carrier particles transported on the image carrying member;

directing the toner carrier particles towards an end of the magnet;

sensing the toner carrier particles at the end of the magnet; and outputting a first signal corresponding to the sensed toner carrier particles.

11. The method according to claim 10, further comprising determining a toner carrier particle level based on the first signal corresponding to the sensed toner carrier particles.

12. The method according to claim 11, further comprising outputting a warning based on the toner carrier particle level exceeding a threshold.

13. The method according to claim 11, further comprising setting a level of a development electric field of the apparatus based on the toner carrier particle level exceeding a threshold.

14. The method according to claim 11, further comprising setting a level of a cleaning electric field of the apparatus based on the toner carrier particle level exceeding a threshold.

15. The method according to claim 10, further comprising:

sensing conditions of the image carrying member away from the toner carrier particles attracted by the magnet; and outputting a second signal corresponding to the sensed conditions.

16. The method according to claim 15, further comprising determining a toner carrier particle level based on a comparison between the first signal corresponding to the sensed toner carrier particles and the second signal corresponding to the sensed conditions.

17. An apparatus comprising:

an image carrying member having a first side and a second side opposite from the first side, the image carrying member configured to operate in a direction of motion, the image carrying member configured to transport an image on the first side;

a magnet coupled to the second side of the image carrying member, the magnet configured to attract toner carrier particles transported on the first side of the image carrying member, the magnet being positioned at an angle with respect to the direction of motion of the image carrying member, the angle configured to direct the toner carrier particles towards an end of the magnet;

a first sensor coupled in proximity to the first side of the image carrying member and coupled in proximity to the magnet, the first sensor configured to sense the toner carrier particles at the end of the magnet and configured to output a first signal corresponding to the sensed toner carrier particles; and a controller coupled to the first sensor, the controller configured to determine a toner carrier particle level based on the first signal.

18. The apparatus according to claim 17, wherein the controller is configured to determine when the toner carrier particle level exceeds a threshold and configured to adjust operations of the apparatus in response to the toner carrier particle level exceeding a threshold.

19. The apparatus according to claim 17, further comprising a second sensor configured to sense conditions of the first side of the image carrying member away from the toner carrier particles attracted by the magnet and configured to output a second signal corresponding to the sensed conditions.

20. The apparatus according to claim 19, wherein the controller is configured to determine a toner carrier particle level based on a comparison of the first signal with the second signal and configured to adjust operations of the apparatus based on the toner carrier particle level exceeding a threshold.

* * * * *